US005170954A

United States Patent [19]

Derichs

[11] Patent Number: 5,170,954

[45] Date of Patent: Dec. 15, 1992

[54] TRANSPORT SYSTEM FOR A TEXTILE MACHINE HAVING MANUAL RE-SUPPLY ASSISTING MEANS

[75] Inventor: Josef Derichs, Monchengladbach, Fed. Rep. of Germany

[73] Assignee: W. Schlafhorst AG & Co., Moenchengladbach, Fed. Rep. of Germany

[21] Appl. No.: 764,356

[22] Filed: Sep. 23, 1991

[30] Foreign Application Priority Data

Sep. 21, 1990 [DE] Fed. Rep. of Germany ..... 4029894

[51] Int. Cl.[5] ..... B65H 67/02; B65H 67/06

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 4,463,909 | 8/1984 | Kiriake et al. | 242/35.5 A |
| 4,570,865 | 2/1986 | Kawarabashi et al. | 242/35.5 A |
| 4,576,341 | 3/1986 | Matsui et al. | 242/35.5 A |
| 4,601,434 | 7/1986 | Mori et al. | 242/35.5 A |
| 4,634,066 | 1/1987 | Matsui et al. | 242/35.5 A |
| 5,024,389 | 6/1991 | Grecksch et al. | 242/35.5 A |
| 5,056,725 | 10/1991 | Wirtz et al. | 242/35.5 A |

FOREIGN PATENT DOCUMENTS

| | | |
|---|---|---|
| B1278308 | 9/1968 | Fed. Rep. of Germany . |
| A2650699 | 5/1978 | Fed. Rep. of Germany . |

*Primary Examiner*—Stanley N. Gilreath
*Attorney, Agent, or Firm*—Shefte, Pinckney & Sawyer

[57] ABSTRACT

A transport system for transporting independently movable tube support members between the winding stations of a textile winding machine and a manual re-supply location is provided. The transport system includes a plurality of individual exit paths, each extending past a winding station and leading to a discharge path along which the tube support members are discharged to the manual re-supply location, and a delivery path for delivering the tube support members from the manual re-supply location to the winding stations. Also, the transport system includes a manual re-supply assisting assembly for assisting an operator with a manual re-supply operation in which full yarn packages are manually loaded onto empty tube support members., The assisting assembly preferably includes a loading guide device for guiding full yarn packages during downward travel thereof onto empty tube support members. The loading guide device includes at least two positioning members cooperating together to guide a yarn package with at least one of the positioning members being movable between a cooperating position and a displaced position in which it is laterally displaced to thereby permit relative movement of the loading guide device and the tube support members without interference between the positioning members and the yarn packages which have previously been loaded on the tube support members. Preferably, the assisting assembly includes sensors for distinguishing between empty tubes and tubes still having remaining yarn thereon and an automatic tube removal component removes tubes from the tube support members.

16 Claims, 7 Drawing Sheets

TRANSPORT SYSTEM FOR A TEXTILE MACHINE HAVING MANUAL RE-SUPPLY ASSISTING MEANS

BACKGROUND OF THE INVENTION

The present invention provides a transport system for a textile machine having manual re-supply assisting means and, more particularly, a transport system which assists an operator in manually re-supply yarn packages to independently movable tube support members which circulate throughout the textile machine.

Textile winding machines are known which are largely automated but in which the removal of tubes and/or the supplying of full yarn packages takes place manually. One well-known approach for supplying full yarn packages is to provide so-called round magazines at the individual winding heads and these round magazines are located above a receiving position of a package insertion location. If a new package is required, the package located in the first position in the round magazine falls out of the round magazine into the insertion device. The round magazine is then shifted one space further and is gradually emptied in this manner.

In another known design of a round magazine, the required package is not freed until the round magazine is shifted sufficiently to cause the package to lose its support when it arrives above the supply chute.

The emptying of the round magazine typically does not take place in a uniform manner. For example, it may occur that yarn packages having residual yarn or even yarn packages whose yarn end was not able to be grasped, may be encountered at one particular winding head. This round magazine then becomes empty more rapidly than the adjacent magazine and, in some instances, the associated winding head is empty before the time for the next manual refilling cycle, as a result of which the winding activity of this winding head is interrupted.

To avoid the problem of uneven supply rates, German patent document DE-B 12 78 308 discloses a system for compensating for the differing package requirements of the individual winding heads which includes a distributing device consisting of a belt with uniformly spaced pockets. The pockets of the belt are automatically filled at the head side of the winding machine in response to the sensing of the arrival of an empty pocket by a sensor. Such a system is not suitable for manual or hand loading since the operator would have to constantly monitor the circulating belt for empty pockets arriving at irregular intervals in order to maintain the smooth functioning of the system.

German patent document DE-A 26 50 699 teaches a separate package loading device which comprises a belt running approximately at table height—i.e., generally at the waist level of an operator—and having support surfaces for the packages on both sides of the belt. The operator removes the full yarn packages from the support surfaces and inserting them onto insertion pins of the particular winding heads. While this device provides a supply of packages at a position in which they can be easily grasped and sorted by the operator, the device does not remedy the problem of distributing the packages onto the individual winding heads in accordance with the package requirements. Accordingly, the need still exists for a manual re-supply arrangement which can flexibly accommodate the differing package requirements of the winding stations of a textile winding stations of a textile winding machine without the need for extensive operator supervision.

SUMMARY OF THE INVENTION

The present invention provides a transport system for transporting full yarn packages to the winding stations of a textile winding machine which includes an arrangement for assisting an operator in a manual package re-supply operation in such a manner that the differing package requirements of the winding station can be flexibly accommodated without extensive operator supervision.

Briefly described the present invention provides a transport system for transporting independently movable tube support members, each tube support member having an upright post and being operable to individually support a tube of the type on which yarn has been built to form a yarn package or an empty tube, and the transport system transporting the tube support members between the winding stations of a textile winding machine at which yarn is unwound from tubes and a manual re-supply location at which full yarn packages are manually loaded onto empty tube support members. The transport system includes means forming a plurality of individual exit paths, each extending past a respective one of the winding stations, and at least one discharge path for receiving tube support members transported away from the winding stations by the individual exit paths for further transport of the tube support members to the manual re-supply location. Also, the transport system includes delivery path means for delivering tube support members from the manual re-supply location to the winding stations and manual re-supply assisting means for assisting an operator with a manual re-supply operation in which full yarn packages are loaded onto empty tube support members. The manual re-supply assisting means includes means forming a loading support path for supporting tube support members at the manual re-supply location, loading guide means for guiding full yarn packages during downward travel thereof onto empty tube support members disposed on the loading support path, and means for moving the loading guide means and the tube support members on the loading support path relative to one another to effect alignment of tube support members with the loading guide means for a manual re-supply operation. The loading guide means includes at least two positioning members cooperating together to guide a yarn package downwardly onto an empty tube support member post. The at least one of the positioning members are movable between a cooperating position in which it cooperates with the other positioning member to position a yarn package for downward travel and a displaced position in which it is laterally displaced from its cooperating position to thereby permit movement of the yarn packages on the tube support members disposed on the loading support path between the positioning members without interference therewith.

The common discharge path preferably extends generally transversely to the individual exit paths, the loading support path extends generally parallel to the discharge path, the downstream end of the discharge path is communicated with the upstream end of the loading support path and the downstream end of the loading support path is communicated with the delivery path means. Also, a tube removal device disposed downstream of said individual exit paths and upstream of said loading guide means and a yarn sensor for sensing the presence of less than a predetermined minimum amount of yarn on a tube supported on a tube support member which has been discharged from a winding station, the tube removal device being operatively connected to the yarn sensor and being operable to remove from the support members those tubes having less than the predetermined minimum amount of yarn.

According to one aspect of the present invention, the delivery path means includes a first portion for delivering tube support members from the loading support path to a first group of winding stations, a second portion for delivering tube support members from the loading support path to a second group of winding stations, and the first portion includes a component repositionable along the travel path of the tube support members along the loading support path for varying the position at which the first portion transports tube support members away from the loading support to thereby permit variation in the number of winding stations in the first group of winding stations.

In a different aspect of the present invention, the transport system includes an automatic yarn package transfer component for automatically transferring yarn packages from a yarn package supply device adjacent the textile winding machine to empty tube support members, an automatic tube removal component for automatically removing tubes from tube support members fed to the automatic yarn package transfer component, and means for selectively bypassing the manual re-supply means. The selectively by-passing includes means for diverting tube support members from the discharge means to the automatic tube removal component and the automatic yarn package transfer component, and means for transporting tube support members with yarn packages thereon from the automatic yarn package transfer component to the delivery path means for delivery thereby to the winding stations.

In one feature of the present invention, the delivery path means includes a reversible portion and a plurality of individual entrance path portions each for transporting tube support members from the reversible portion to a respective one of the winding units, the reversible portion being operable to cyclically reverse the direction of travel of the tube support members along the upstream ends of the individual entrance path portions and having a stop member at each respective end of the travel path of the tube support members on the reversible path to limit the travel of the tube support members. According to another feature of the present invention, each tube support member includes a base cylindrical portion and the loading guide means includes a plurality of pairs of said positioning members, each pair of positioning members for positioning a yarn package on a tube support member on the loading support path. The at least one of the positioning members of each pair of positioning members is movable between a cooperating position in which it cooperates with the other positioning member to position a yarn package and a displaced position in which it is laterally outwardly displaced from its cooperating position to thereby permit movement of the yarn packages on the tube support members disposed on the loading support path between the positioning members without interference therewith. Also, the pairs of positioning members are positioned at spacings from one another corresponding to the diameter of the base cylindrical portion of a tube support member such that the pairs of positioning members can be aligned in groupwise manner with a group of underlying tube support members disposed in successive substantially abutting engagement with one another on the loading support path.

According to a further feature of the present invention, the loading guide means includes means for synchronously moving the at least one movable positioning members of the pairs of positioning members between their cooperating and displaced positions. Also, the transport system further includes sensing means, located adjacent the loading support path, for distinguishing between an empty tube support member and a tube support member having a tube thereon and stopping means for stopping the passage therepast of tube support members in response to the sensing by the sensing means of an empty tube support member for positioning the empty support members in position for a manual re-supply operation.

In yet another aspect of the present invention, the means for relatively moving the loading guide means and the tube support members includes a rail extending generally parallel to the loading support path and a drive device for driving the loading guide means along the rail. Also, the transport system includes means for controlling the movement of the loading guide means along the rail to effect stopping of the loading guide means at predetermined intervals along the rail, the predetermined intervals being selected such that the pairs of positioning members are aligned with underlying tube support members each time the loading guide means is stopped along the rail.

By providing a storage area for independent tube support members, the transport system of the present invention supplies a plurality of winding heads with feeding packages and also permits a sufficient supplying of all winding heads under different or changing unwinding conditions even during manual loading. The operator need only supply one storage area for a plurality of winding heads with feeding packages. The design of the storage area is considerably simplified in comparison to round magazines provided at every winding head. The loading of the storage area is possible with minimum strain for the operator.

In the parallel arrangement of the storage area in relation to the return transport stretch, the storage area is arranged at the same height as, or at a height differing from, the return transport stretch.

As a result of the arranging of a tube removal device directly in the transport path of the tube support members, the operator need only be concerned with the task of supplying empty tube support members with new feeding packages. Several batches can be processed at the same time on a package winding machine in accordance with the invention. The positioning of the stoppers along the reversing belt forming the package distributing stretch in conjunction with the arrangement of several connecting pieces which can be positionally changed for the supplying and removing of the tube support members to and from the storage area permits the variable shaping of winding sections.

The construction of the transport system permits an operator to switch the system over to a central, automatic tube removal and feeding package supply arrangement with relative ease. Moreover, the arrangement of yarn end preparation devices in the particular supply path relieves the operator of the task of readying the starting end of the yarn. A stopper at the end of the storage area prevents empty tube support members from passing onto the supply path.

The adjacent arrangement of three chute components of the loading device makes a rapid supplying possible since the operator can readily introduce three packages simultaneously with both hands into these chute components. It is possible thereby to arrange the upper opening of the chute components at a height which is lower than is the case in the customary round magazines. This results from the total design, especially the possibility of the relatively low arrangement of the transport paths of the tube support members in the transport circuit. The strain on the operator is minimized in this manner. The arrangement of sensors and stoppers in the storage area removes the need for the operator to perform additional monitoring steps. The capacity of the storage area is dimensioned such that it can be filled at convenient time intervals without the winding heads being undersupplied.

DESCRIPTION OF THE PREFERRED EMBODIMENT

Figure 1:
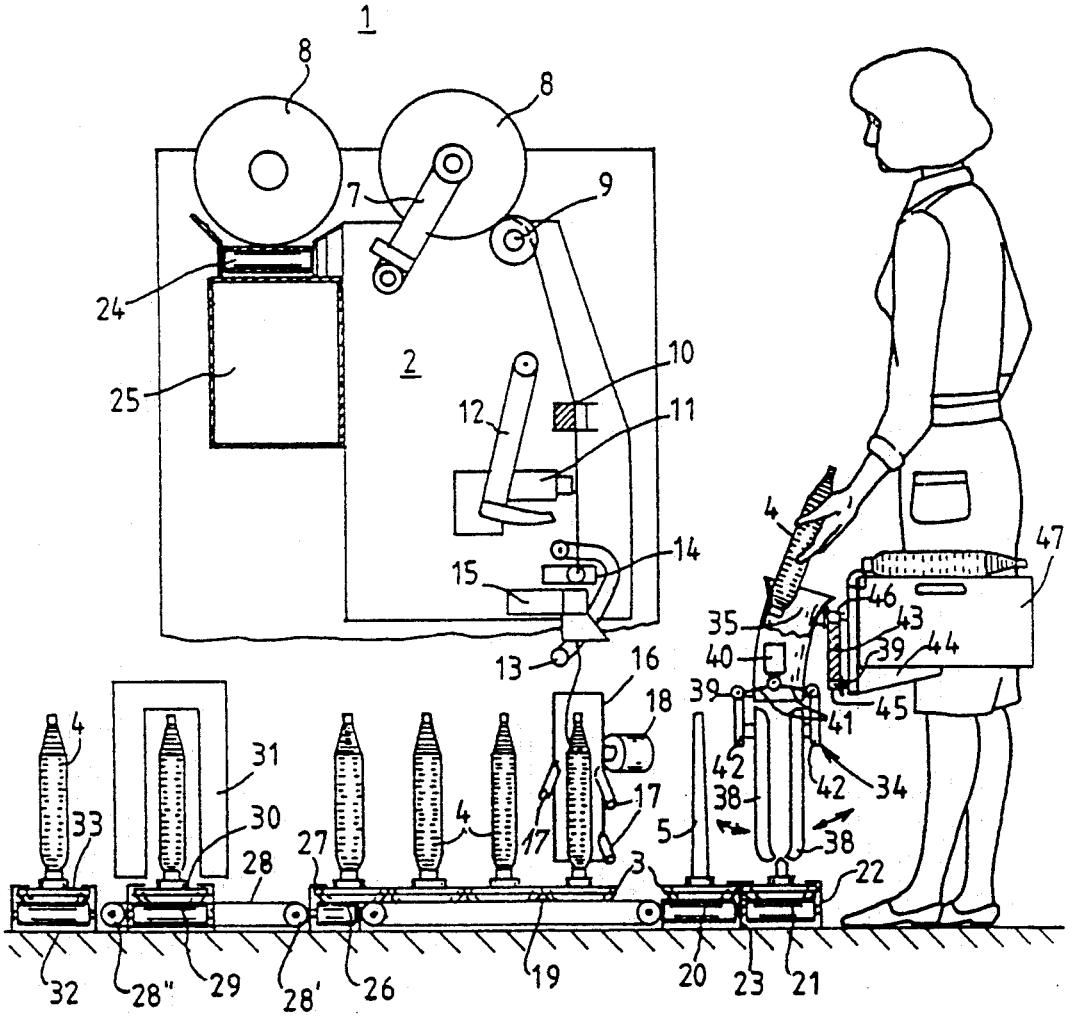
FIG. 1 is a side elevational view of one embodiment of the transport system of the present invention for transporting tubes and yarn packages on a textile winding machine.

In FIGS. 1–4 and 6, one embodiment of the transport system of the present invention is illustrated for transporting a plurality of full yarn packages 4, partial yarn packages 6, and empty tubes 5 between the winding stations of a textile winding machine 1 and a location at which the yarn packages or empty tubes are further handled and/or replaced with full yarn packages. As seen in FIG. 1, the textile winding machine is of the type having a plurality of winding heads 2, each located at a respective one of the winding stations, for winding yarn from a full package 4 supported at the winding station.

A yarn is supplied from a full yarn package 4 standing on an tube support member 3 past a suction device 15 through a yarn tensioner 14 and yarn cleaner 10 to a cross-wound package 8 and wound onto it. Drive drum 9, which is designed as a reverse-threading roller, drives the cross-wound package mounted in a creel 7 and places the yarn obliquely to the direction of winding at the same time by means of its guide groove. The package stands during the unwinding in a yarn end loosening chamber in the form of a longitudinally divided sleeve 16, whose two halves can be moved apart from one another, the structure and operation of the yarn end loosening chamber being described in more detail in U.S. Pat. No. 5,024,389, which is hereby incorporated by reference herein. Only one sleeve half can be seen in FIG. 1. The opening and closing of the sleeve is performed by actuating devices 18. The sleeve halves in their open position free the transport of the particular tube support member 3 for transport by a transversal belt 19. This release is necessary for the exchange. Thus, for example, an unwound package, that is, a tube 5, is transported when the sleeve 16 is opened by the transversal transport belt 19 to the belt 20 running transversally to the latter whereas a ready full yarn package 4 is introduced with its tube support member 3 into open sleeve 16, which then closes again. In the closed position, the tube support member is prevented by the sleeve from being transported by the transversal belt 19.

The starting end of the yarn of new full yarn package 4 is separated by a helical current of air which is directed upward and generated by blow nozzles 17 and is supplied to a grasping tube 13, at which there is a vacuum due to a connection line (not shown) to a suction traverse 25 running through the frame walls 61 (see FIG. 2) of the winding machine. This grasping tube is pivoted upward after the grasping of the starting end of the yarn, as a result of which it places the yarn supplied from the package into a splicing device 11 and a yarn cleaner 10. The starting end of the yarn run onto the cross-wound package 8 is engaged from cross-wound package 8 by a suction tube 12, which also comprises a connection to the suction traverse 25, and is placed into the yarn cleaner 10 and the splicing device 11. The yarn connection is then produced by the splicing device and the winding process can start anew. The full cross-wound packages 8 are removed by a replacement carriage (not shown) from the creel 7 and deposited onto the belt 24 for cross-wound packages, which supplies these packages 8 to a package removal device arranged at the head end of the winding machine.

A reversing belt 26 on which tube support members 3 circulate with full yarn packages 4 runs in front of the transversal belts 19 in order to supply these tube support members with packages as required to the particular transversal belts 19. During the transport of tube support members 3 by the reversing belt 26, they are guided laterally by a guide rail 27 extending parallel to the belt 26 adjacent one lateral side thereof and by those tube support members 3 already on the transversal belts 19. For example, if a package replacement takes place in a winding head 2, the two tube support members 3 standing in waiting position are transported to the right by the transversal belt 19. As a result thereof, the next tube support member 3 arriving on reversing belt 26 loses its guidance and is drawn from transversal belt 19 into the hindmost waiting position of the winding head. This is possible because the transversal belt 19 extends into the transport path of the tube support members circulating on the reversing belt 26. In this manner, an automatic sufficient supplying of the winding heads with new full yarn packages 4 independent of the requirements of any one particular winding station. The supplying of new full yarn packages 4 on their tube support members 3 to the reversing belt 26 takes place via an interconnecting belt 28, which is associated with a yarn end preparation belt 29. A yarn end preparation device 31, which is shown only in a schematic fashion here, is arranged in the transport path of tube support members 3 with full yarn packages 4 which path is formed by the belt 29. The yarn end preparation device 31 loosens and engages the starting end of the yarn on the yarn surface, cuts the loosened yarn end to length, and then disposes the cut yarn end in such a manner on the yarn package that it can be resupplied at the unwinding position to the yarn receiving members. The tube support members 3 are guided by a pair of opposed flange members 30 along the transport path formed by the belt 29, as seen in FIG. 1.

The belt 32 runs parallel to the belt 29, and the tube support members are supplied to the belt 29 from the belt 32 by a transport connection to be described later. The tube support members are guided in a channel 33 formed by a pair of opposed flange members as they travel along the belt 32.

Figure 2:
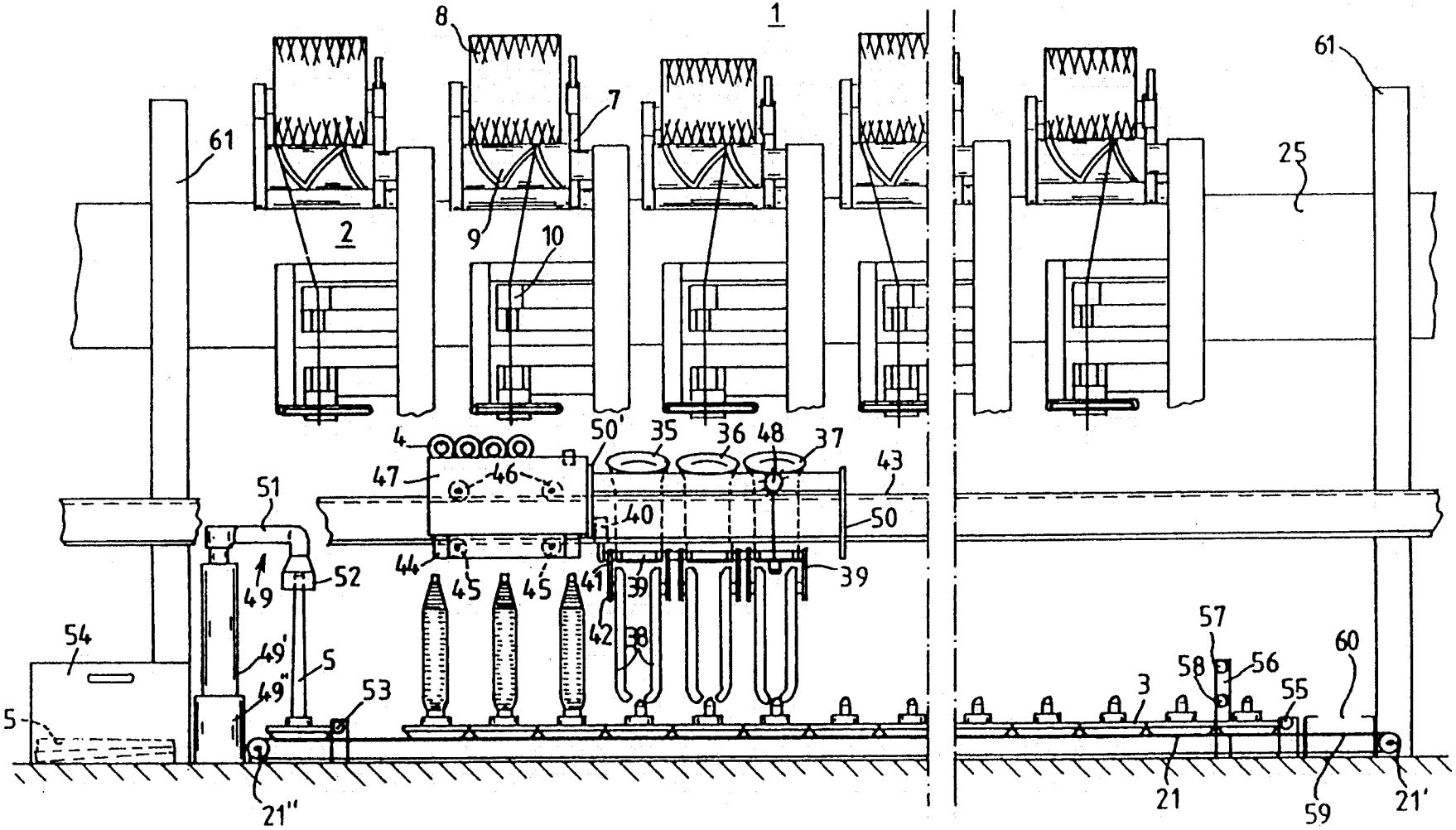
FIG. 2 is a front elevational view of the transport system shown in FIG. 1.
Figure 6:
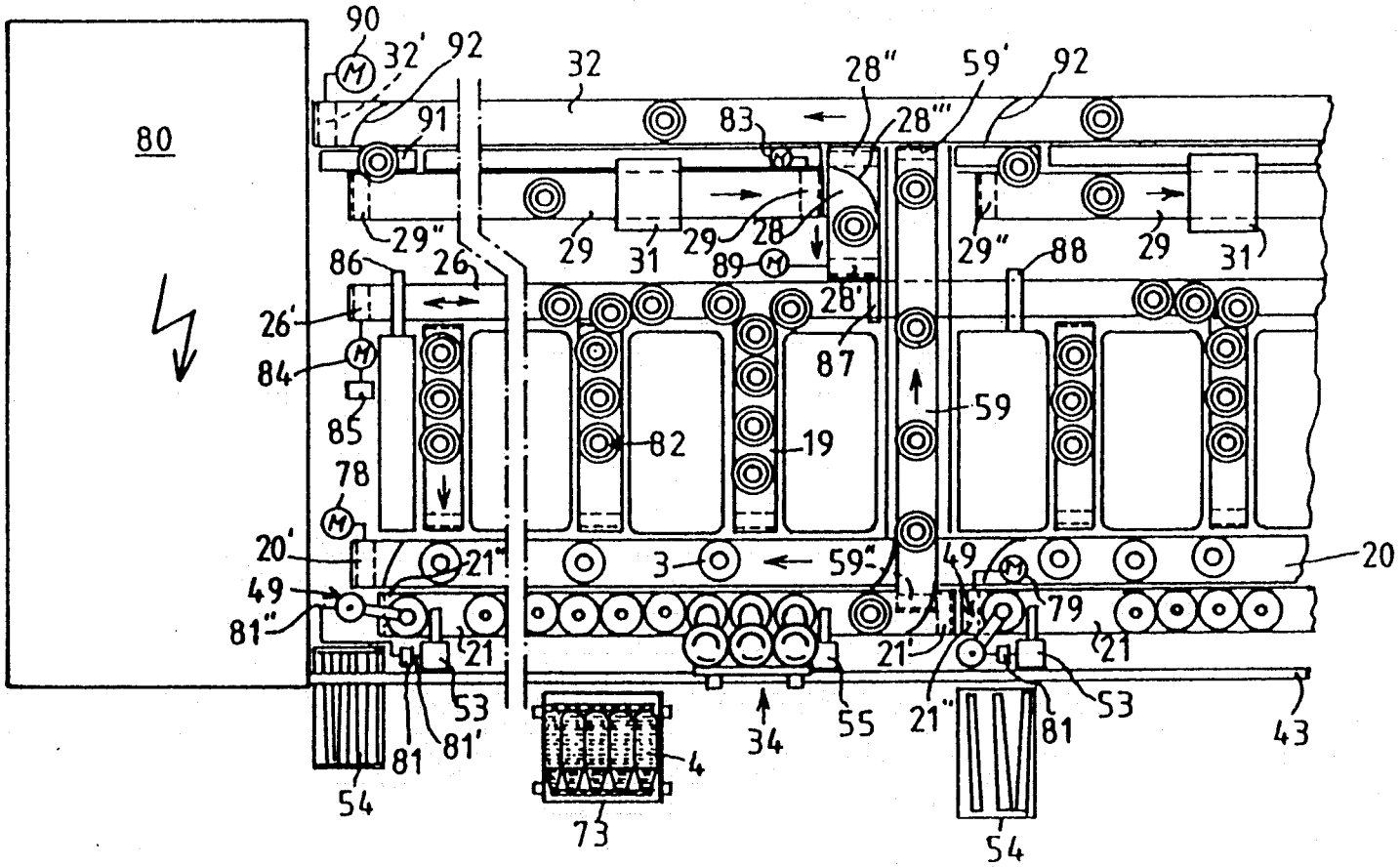
FIG. 6 is a top plan view of the embodiment of the transport system shown in FIGS. 1–4.

The transport system of the present invention also includes a manual re-supply assisting means for assisting an operator with a manual re-supply operation in which full yarn packages are loaded onto the empty tube support members 3. Additionally, the manual re-supply assisting means includes the capability for distinguishing between those tube support members 3 having an empty tube 5 supported thereon and those tube support members 3 having a partial or full yarn package 6 as well as the capability to remove the empty tubes 5 to place tube support members in an empty status. The manual re-supply assisting means includes means forming a loading support path for supporting the empty tube support members 3 at a manual re-supply location. The means forming a loading support path includes, as seen in FIGS. 1 and 2, an endless belt 21 trained around a conventional guide roller 21' and a conventional drive roller 21'', which is operatively connected to a drive motor 79, as seen in FIG. 6, for driving operation of the belt 21 in a direction opposite to the direction of movement of the belt 20. As seen especially in FIGS. 1 and 2, the belt 21 supports a plurality of the tube support members 3 thereon in a loading support path.

The manual re-supply assisting means further includes loading guide means for guiding full yarn packages during downward travel thereof onto the empty tube support members 3 supported on the loading support path formed by the belt 21. The loading guide means is the form of a movable loading device 34 having a plurality of single package chute components 35–37. Each single package chute component 35–37 includes a pair of positioning members 38 which cooperate together to position a full yarn package 4 disposed in the single package chute component for guided receipt of the yarn package on the post of an empty tube support member 3 supported on the loading support path. As seen in FIG. 2, each positioning member 38 extends generally parallel to the axis of the underlying tube support members and tapers axially inwardly at its lower end. Each positioning member 38 includes a pivot arm 42 secured to its upper end, as seen in FIG. 1. Each pivot arm 42 is pivotally connected by a pivot bolt 39 to the free end of one arm 41 of a toggle mechanism. The toggle mechanism includes a central pivot to which the other end of each of the arms 41 is pivotally connected. A solenoid 40, as seen in FIGS. 1 and 2, is fixedly mounted to a frame 50' on which the single package chute components 35–37 are fixedly mounted. The solenoid 40 includes a plunger whose free end is pivotally connected to the central pivot of the toggle mechanism and the solenoid 40 is operable to selectively extend its plunger to effect movement of the pair of positioning members 38 of each single package chute component radially outwardly and to retract its plunger to effect movement of the respective pair of the positioning members 38 of each single package chute component toward one another.

Each positioning member 38 is movable between its cooperating position in which it cooperates with the other respective positioning member of the pair to properly position a full yarn package 4 for guided receipt on an underlying tube support member 3 and a displaced position in which the positioning member is laterally outwardly displaced from its cooperating position. The disposition of the positioning members 38 is their displaced positions allows relative movement between the loading device 34 and the underlying tube support members 3 on the loading support path, as will be described in more detail below.

With further regard to the details of the loading device 34, the loading device includes a yarn package storage container 47 mounted to a bracket assembly 44. A pair of lower rollers 45, as seen in FIGS. 1 and 2, are rotatably mounted to the bracket assembly 44 and a pair of upper rollers 46 are rotatably mounted to the bracket assembly 44. The upper rollers 44, which can be in the form of grooved or flanged rollers, are supported for rolling travel along a rail 43 which extends parallel to the belt 21 at a height above the floor on which the textile machine 1 is supported while the lower rollers 45 are arranged to roll along the bottom of the rail 43. The rollers 45,46 mount the bracket assembly 44 to the rail 43 for rolling travel of the bracket assembly 44 along the axis of the rail.

Figure 4:
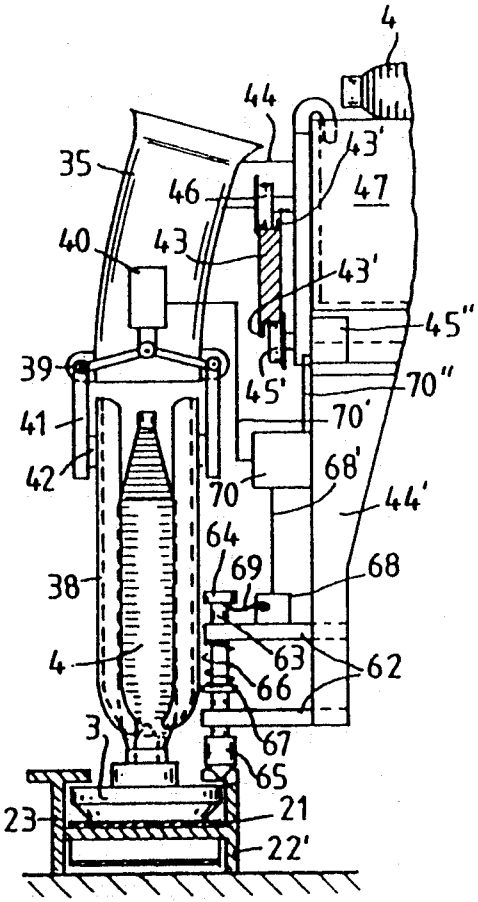
FIG. 4 is a side elevational view of the loading guide means shown in FIG. 3.

In FIG. 4, one variation of the rollers 45,46 is illustrated in which the upper rollers 46 are configured as flanged rollers having a flange on one side only and the lower rollers 45 are in the form of flanged rollers having a flange 45' on one side only. The rail 43 is formed with a pair of lateral edges 43' extending along the top and bottom surfaces of the rail on respective opposite lateral sides thereof. The lateral flanges 43' prevent lateral movement of the bracket assembly 44 beyond an extent which would cause separation of the bracket assembly 44 from its mounted position on the rail 43.

The package supply container 47 includes a pair of brackets 50,50', as seen in FIG. 2, particularly adapted for engagement by the hip of an operator to effect rolling movement of the bracket assembly 44 along the rail 43. The rail 43 is preferably located at a selected height above the floor such that the brackets 50'50' are generally at the height of the hips of an average operator. As seen in FIG. 2, the package supply container 47 is provided with a capacity to receive a plurality of full yarn packages 4 arranged in an axially-aligned, side-by-side configuration, for ready access of an operator to the supported full yarn packages 4.

The brackets 50,50' extend sufficiently laterally outwardly of the rail 43 to permit ready engagement of the brackets by the hips of an operator.

As seen in FIG. 2, the loading device 34 preferably includes a means for controlling the rolling movement of the loading device relative to the rail 43. For example, as seen in FIG. 2, a cog wheel 48 can be pivotally mounted to a frame member extending between the brackets 50,50' for meshing engagement with a cog track (not shown) formed on the upper surface of the rail 43. The cog arrangement can be appropriately configured to insure that the extent of travel of the loading device 34 is in uniform increments selected in relation to the diameter of the base circumferential portions of the tube support members to thereby facilitate the stopping of the loading device 34 at positions in which the single package chute components 35–37 are aligned with the underlying empty tube support members 3 on the loading support path.

Figure 3:
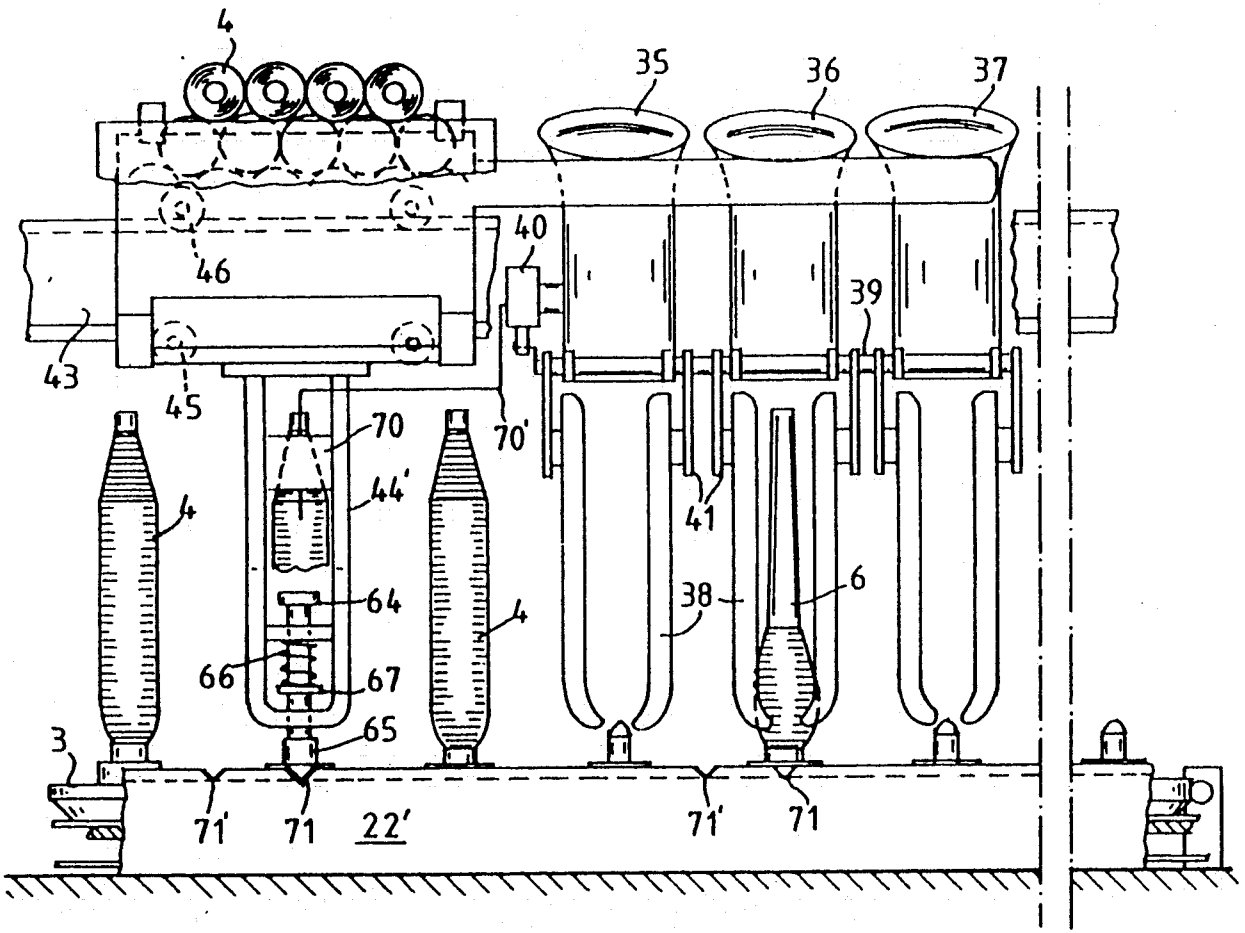
FIG. 3 is a front elevational view of a variation of the loading guide means of the transport system shown in FIGS. 1 and 2.

As seen in FIGS. 3 and 4, the present invention also contemplates another arrangement for insuring the reliable stopping of the loading device 34 at positions along the rail 43 in which the single package chute components 35–37 are already aligned with underlying package support members 3. In this arrangement, the manual re-supply assisting means also includes a means for controlling the movement of the loading device 34 along the rail 43 to effect stopping of the loading device at predetermined intervals along the rail, the predetermined intervals being selected such that each of the single package chute components 35–37 is aligned with an underlying tube support member each time the loading device 34 is stopped along the rail. A notch rail 22' is provided which extends parallel to the belt 21 adjacent the outward lateral side thereof has a plurality of pre-engagement notches 71' at uniform spacings therealong and a plurality of stoppage notches 71 spaced at uniform spacings along the notch rail 22'. The uniform spacing between the notches 71,71', respectively, is selected in correspondence with the diameter of the base circumferential portion of a tube support member 3 in relation to the number of single package chute components of the loading device 34. For example, the embodiment of the loading device 34 shown in FIGS. 1–4 includes the three single package chute components 35–37. Accordingly, the spacing between each adjacent pair of notches 71,71', respectively, is selected as the product of three times the diameter of the base circumferential portion of a tube support member 3. Thus, each time the loading device 34 is stopped along the rail 43 by the movement controlling means, each of the single package chute components 35–37 is aligned with an underlying tube support member 3 for subsequent manual loading of a yarn package 4 onto the underlying tube support member.

The movement controlling means comprises, as seen in FIGS. 3 and 4, a generally U-shaped bracket 44' mounted to the underside of the bracket assembly 44 and extending downwardly therefrom. A slide bolt 63 is slidably mounted to the bracket 44' and includes a notch engagement tip 65 formed on its free end which projects downwardly below the bracket 44'. A spring 66 is mounted against a crosspiece 62 of the bracket 44' in which the slide bolt 63 is slidably mounted and the spring 66 acts against a flange 67 formed on the slide bolt 63 to bias the slide bolt 63 downwardly. The slide bolt 63 includes a radially enlarged head 64.

In operation, the spring 66 continuously biases the slide bolt 63 downwardly such that the notch engagement tip 65 continuously travels along the top surface of the notch rail 22'. When the notch engagement tip 65 rides downwardly into one of the notches 71,71' due to the biasing action of the spring 66, the radially enlarged head portion 64 of the slide bolt 63 moves downwardly into contact with a feeler 69 of switch 68, as seen in FIG. 4, which signals a relay 70 mounted on the bracket 44'. The relay 70, in turn, signals the solenoid 40 via a lead 70' to move the positioning members 38 from their displaced positions to their cooperating positions.

The pre-engagement notches 71', each of which is positioned a relatively small distance ahead of an engagement 71 relative to the direction of travel of the loading device 34 along the rail 43, are provided to effect a braking process. The relay 70 is configured to initiate a braking process in response to a signal from the switch 68 each time the notch engagement tip 65 travels downwardly into one of the pre-engagement notches 71 and this braking process assures that the loading device 34 is properly braked once the relay 70 receives a signal that the notch engagement tip 65 has subsequently traveled downwardly into one of the engagement notches 71.

As seen in FIG. 6, the tube support members 3 circulate in a winding section inside a closed loop or circuit. The tube support members 3 with full yarn packages 4 or residual packages 6 released by the stopper 55 are diverted at the end of belt 21 by conventional guide members onto a belt 59. The belt 59 extends over the belt 20 and is trained around a deflection roller 59'' is located intermediately above the two sides of the belt 21. The belt 59 empties into a belt 32, which transports the tube support members 3 against a guide member 92, which, in turn, guides them via a roller 91 to a belt 29. The conventional yarn end preparation device 31 is located on a belt 29, which is driven by a motor 83 via a deflection roller 29' and is trained around a deflection roller 29''. After the package preparation has taken place, the tube support members 3 with the full yarn packages 4 are supplied via another belt 28 to a reversing belt 26. The belt 28 is driven by a motor 89 via a deflection roller 28' and is trained around a deflection roller 28''.

The change of the direction of transport of the tube support members 3 from the belt 29 onto the belt 28 is effected by a guide member 28'''. The reversing belt 26 cyclically changes its direction of transport at adjustable time intervals. To this end, it is connected via its deflection roller 26' to a motor 84, which is, in turn, coupled via a control connection to a time relay 85 for controlling the reversing motion. The transport path of the tube support members 3 onto the corresponding sections is limited by a plurality of stops 86,87 and 88. The reversing belt 26 acts as a distribution means for the tube support members 3 with the full yarn packages 4 or the residual packages 6.

An end frame 80 is located at the head end of the winding machine and contains the centrally controlled supply devices, especially the energy supply of the winding machine. However, the individual winding stations are largely independent of each other and designed in an analog manner. As seen in FIG. 6, a separate one of the belts 21 is provided for each package section. The drive of the belts 21 takes place via the motors 79 and deflection rollers 21', whereas they are deflected at the other end by deflection rollers 21''. The belt 20 forming the discharge path is continuous and is driven via a deflection roller 20' by a motor 78. A deflection roller (not shown) is located at the other end of the belt 20. The belt 59 is driven via a deflection roller 59' and deflected by another deflection roller 59''. The conventional drive of the deflection roller 59' is not shown here for reasons of clarity. The drive of the belt 32 is effected by a deflection roller 32' driven by a motor 90. The deflection roller located at the other end of the belt is also not shown here.

A stopper 55 is arranged in the end area of the belt 21 which prevents the further transport of tube support members 3 which have not yet been provided with fresh yarn packages. This stopper 55 is controlled by a sensor block 56, which comprises a pair of sensors 57,58 mounted at different heights relative to one another. The sensor 58 is operable to sense the through passage of a tube support member 3, and the sensor 57 is located above the level of the posts of the tube support members and senses the passage of a full yarn package 4 or partial yarn package 6 therepast. The stopper 55 remains open until the lower sensor 58 alone senses the passage of an tube support member 3 while, at the same time, the upper sensor 57 does not sense the presence of a tube or yarn package on the sensed tube support member 3. This assures that no empty tube support members 3 are supplied to the belt 59, which transports the tube support members with packages to the supply stretches of the package winding machine. These empty carriers are backed up in succession on the belt 21 as a result thereof until the operator supplies new full yarn packages 4 via loading device 34.

Figure 7:
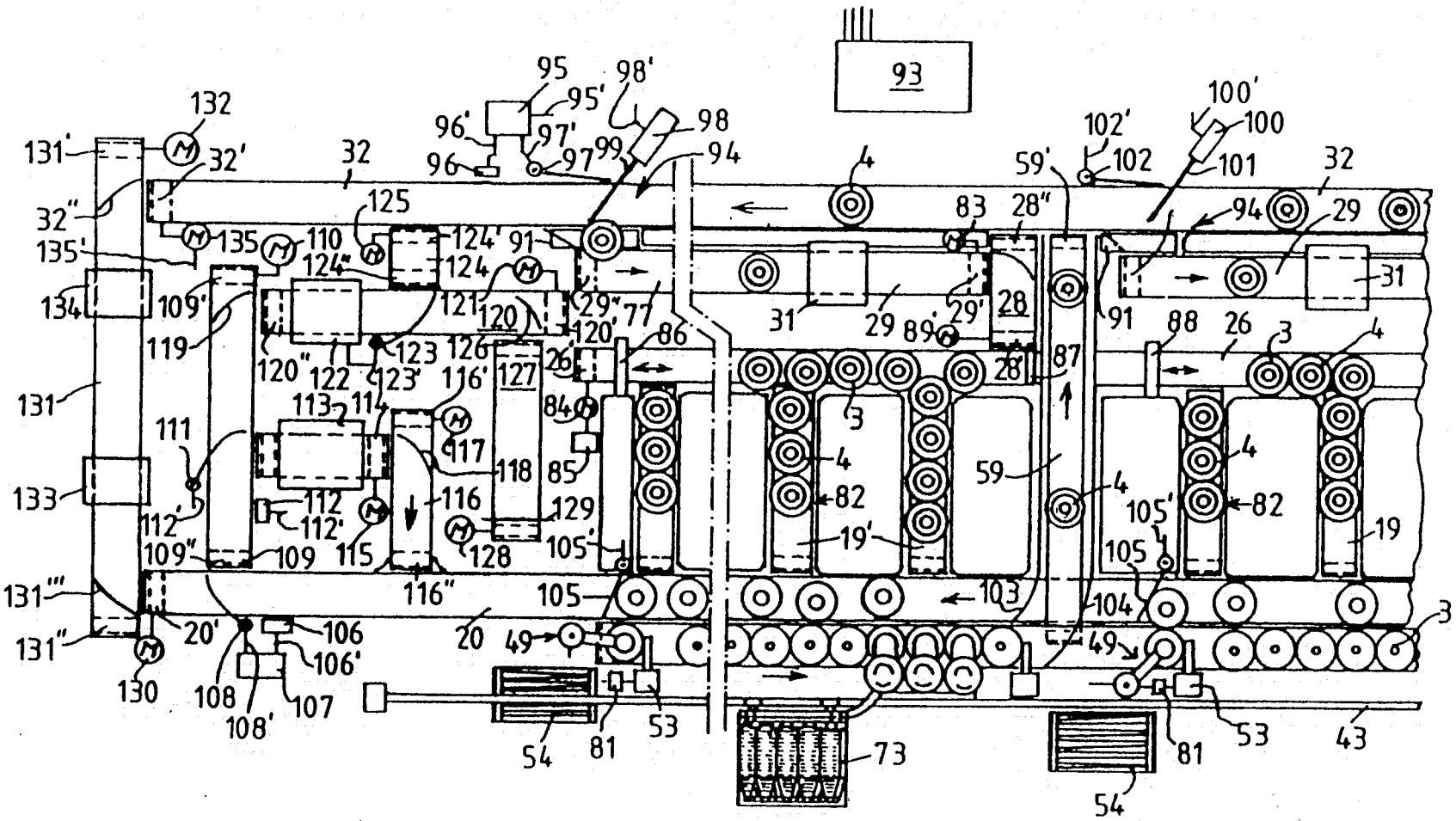
FIG. 7 is a top plan view of a further embodiment of the transport system of the present invention, showing the transport system in a manual re-supply configuration.
Figure 8:
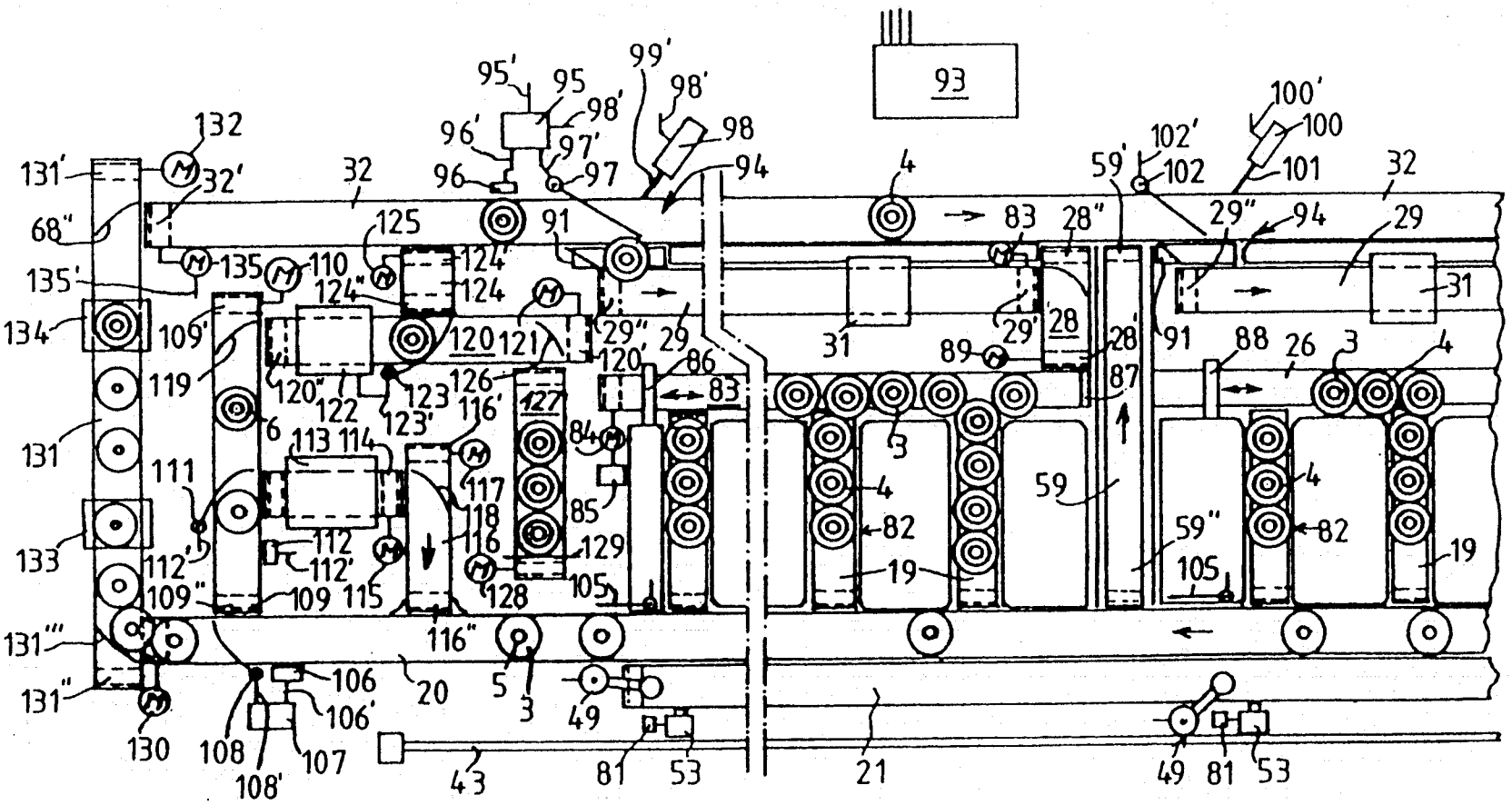
FIG. 8 is a top plan view of the further embodiment of the transport system shown in FIG. 7 and showing the transport system in an automatic yarn package re-supply configuration.

The stopper 55 is preferably connected to a switch (not shown) which can comprise a sliding contact to a lead on the rail 43. This switch carries weak current and is actuated by the operator after tube support members 3 standing ready on storage belt 21 have been filled with full yarn packages 4. The actuation of the switch releases these tube support members from the stopper 55 and supplies them via the belt 59 through the guide canal 60 to a belt 32 located on the other side of the package winding machine (FIGS. 6–8). The operator can continue with other operations during the emptying of the belt 21 since the sensor block 56 automatically monitors when the first arriving empty tube support member 3 arrives in front of the stopper 55 and automatically closes the stopper 55 upon the detection of the first arriving tube support member 3.

To simplify control of the movement of the loading device 34 along the package winding machine section entrainment means the brackets 50,50′ can contain switches (not shown) to which brakes and/or power amplifiers can be coupled.

A tube removal device 49 is located at the entrance side of the tube support members into the storage belt 21. A stopper 53 assures that the particular tube support member 3 is stopped in the tube removal position. This stopper 53 is controlled by the sensor signals of a sensor 81 to which it is connected via control lead 81′. This sensor 81 distinguishes between residual packages 6, which can be re-supplied to the winding stations for further processing, and empty tubes 5 or tubes with a slight winding remnant which are deemed to be not worth recirculating to the winding units. The sensor 81 closes the stopper 53 via control lead 81′ when it has recognized a tube 5 which is empty or one which cannot be processed further, that is, which contains a very slight amount of yarn. The stopper 53 remains open during the passage of a partial yarn package 6. An operator can later readily recognize when a partial yarn package 6 is still inserted on one of tube support members 3 since the relatively large intermediary spaces between guide members 38 of loading device 34 permit easy visual access to determine the presence of a residual package 6. The operator need then supply only the other chute components with full yarn packages 4.

The tube removal device 49 includes a gripper arm 51 which can move in a vertical manner inside a hydraulic cylinder 49′. The hydraulic cylinder 49′, which is connected to a rotary drive (not shown) and located in a foot 49″ of the tube removal device 49, effects pivoting movement of the gripper arm 51. The gripper arm 51 carries a gripper 52 on its front end which clamps the top portion of a tube 5 during removal and during the pivot motion, e.g., by means of a pneumatically actuated clamp, and releases the gripped tube 5 again over a tube container 54 positioned adjacent the gripper arm 51. The tube removal device is actuated via control lead 81″ (see FIG. 6).

Figure 5:
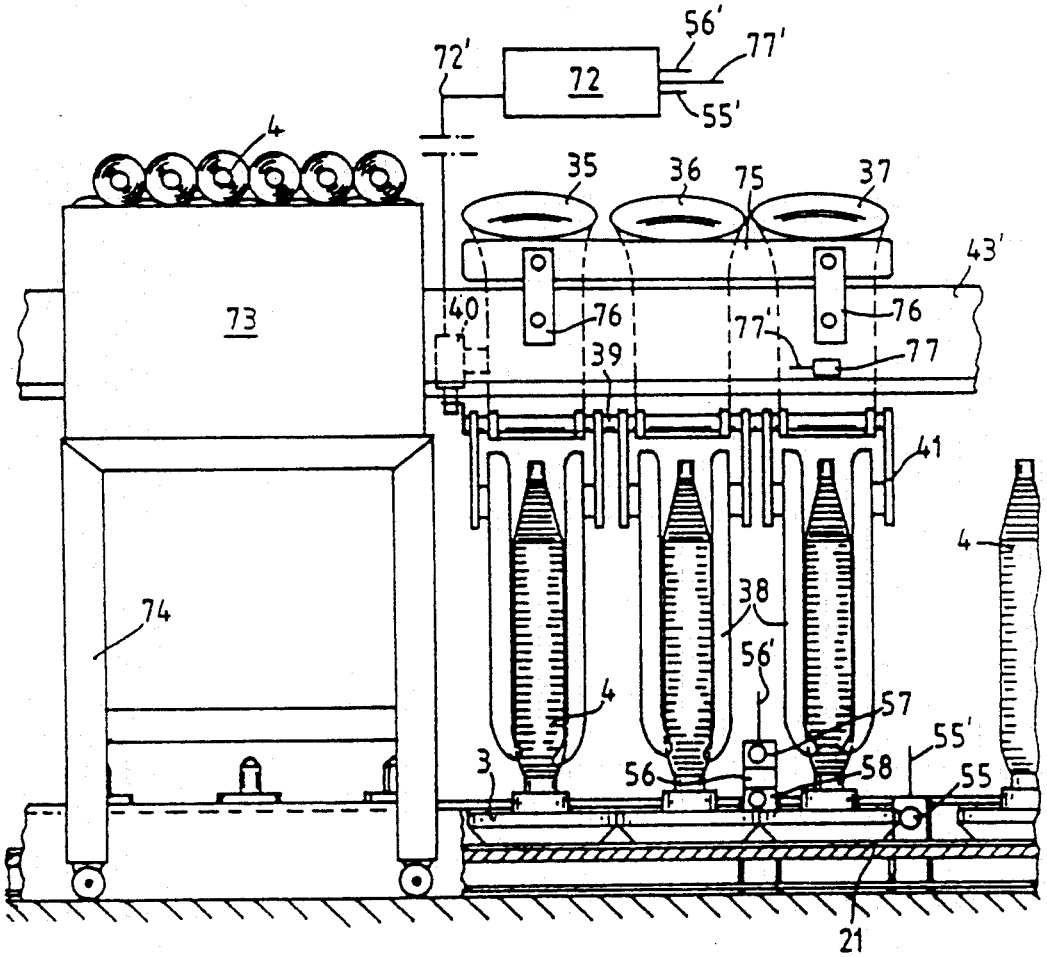
FIG. 5 is a front elevational view of a portion of another embodiment of the transport system of the present invention.

In FIG. 5, another embodiment of the transport system of the present invention is illustrated which is identical in all respects to the embodiment illustrated in FIGS. 1–4 and 6, except the loading device 34 in this embodiment is stationary. A separate, independently movable yarn package storage container 73 is provided having a wheeled frame 74 for rolling travel along the floor.

A mounting bracket 75 commonly mounts the single package chute components 35,36,37 via fastening strips 76 to the rail 43′. In this embodiment, the stopper 55 is opened every time when the three tube support members under the single package chute components 35,36,37 have been loaded with packages. A sensor 77 located in the foremost chute component 37 senses the through passage of a full yarn package 4 and signals this via a lead 77′ to a central control unit 72. The solenoid 40 is then actuated via a control lead 72′ (with a short delay) to thereby effect opening of the positioning members 38 to their displaced positions. Shortly thereafter, the stopper 55 is withdrawn, as a consequence of which the path for the tube support members to the belt 59 is again open. The stopper 55 is controlled via a control lead 55′. The stopper 55 remains withdrawn until an empty tube support member 3 passes the sensor block 56, whereupon the sensor block signals this passage of an empty tube support member 3 via a lead 56′ to the central control unit 72, which then closes the stopper 55 via the control lead 55′.

Since the sensor block 56 senses the first empty tube support member 3 in every instance, this also assures that an empty tube support member is always standing under the single package chute component 37, even if residual packages 6 arrive. If a partial yarn package 6 immediately follows the tube support members 3 which have been freshly provided with the full yarn packages 4, a through signal is initiated in both sensors 57,58, as a result of which the stopper 55 remains open. The result of this is that a full yarn package 4 must be introduced into the single package chute components 35–37 in every instance, which generates a package passage signal on sensor 77.

The loading device 34 in the embodiment of FIG. 5 does not move and a package container 73 on a separate package carriage 74, can be provided, which can also be moved to the side in order to make it possible to access the winding heads.

In FIGS. 7 and 8, a further embodiment of the transport system of the present invention is illustrated and, in this embodiment, the transport system can be selectively reconfigured between a manual loading configuration in which the manual re-supply assisting means is used to effect re-supply of yarn packages to the tube support members and an automatic yarn package re-supply configuration in which yarn packages are automatically resupplied to the tube support members while the manual re-supply assisting means remains out of service. FIG. 7 illustrates the arrangement of the transport system in its manual re-supply configuration and FIG. 8 illustrates the arrangement of the transport system in its automatic yarn package re-supply configuration.

A plurality of shunts 105 located on the belt 20 extend into the transport path formed by this belt for diverting the tube support members 3 onto the adjacent belt 21. A plurality of deflection profiles 103,104 are provided for the supplying of the tube support members 3 to the belt 59 and are removably mounted. The belt 59 is also removably mounted.

A pair of plungers 99,101 are selectively extendable from the hydraulic cylinders 98,100, respectively, into the transport track formed by the belt 32 for diverting tube support members from the belt 32 to the belts 29 via the rollers 91.

A central control unit 93 switches the transport system to a centrally controlled supplying arrangement via actuation of the pair of hydraulic cylinders 98,100 as well as the shunts 97,102 connected to the central control unit via control leads 95', 100', 102' and connected as well to another control unit 95. The plungers 99,101 are withdrawn into the hydraulic cylinders 98,100. The direction of rotation of a motor 135 is reversed via a signal transmitted on a control lead 135' to drive the belt 32 in the opposite direction via the deflection roller 32'. A shunt 102, controlled directly from central control unit 93, is pivoted into the transport path of the belt 32 to divert arriving tube support members 3 with the full yarn packages 4 via the roller 91 to the belt 29.

The shunt 97 is switched by the control unit 95 via a control lead 97' to a diverting position across the belt 32. A sensor 96, which senses the passage of an tube support member 3 therepast and is connected via a lead 96' to the control unit 95. The sensor 96 effects the alternating switching over of the shunt 97 to its diverting position, as a result of which the arriving tube support members 3 are distributed uniformly onto the two successive winding sections. The sensor 96 can also be configured to sense markings on the tube support member 3 or the full yarn package 4 which uniquely identify the batch of the yarn package 4. In this instance, the supply takes place in accordance with the correct batch to the individual winding sections.

The deflection roller 20' of the belt 20 is driven by a motor 130. The belt 20 transports the tube support members with empty tubes 5 against a deflection edge 131'''of a belt 131. This belt 131 is driven via a deflection roller 131' connected to a motor 132 and trained around a deflection roller 131''. A tube removal device 133 and a yarn package placing device 134 are located on the belt 131. The full yarn packages 4 supplied from the spinning machine are placed on tube support members 3 by the placing device 134 and are transported by the belt 131 along a deflection edge 32'' onto the belt 32. This belt 32 transports the tube support members 3 with their full yarn packages 4 to a plurality of branch paths 94, which lead into the particular winding section.

In order to differentiate between empty tubes 5, tubes with a slight winding remnant and residual packages 6, a sensor 106 is located at the end of the belt 20. If this sensor senses a partial yarn package 6 or a tube 5 with a slight winding remnant, a shunt 108 is moved into the position shown in FIG. 8 via a control device 107. As a result thereof, the tube support member 3 carrying the partial yarn package 6 or the tube 5 with a slight winding remnant is guided onto the belt 109. This belt 109 is trained around deflection rollers 109',109''. A motor 110 drives the deflection roller 109'. Another sensor 112 is located on the belt 109 which comprises a connection 112' to a shunt 111. If this sensor recognizes a fairly large yarn remnant, that is, a partial yarn package 6, it opens the shunt 111, which therewith frees the path along the belt 109. This tube support member with the partial yarn package 6 is then transported against a deflection edge 110, which deflects this tube support member 3 onto another belt 120. This belt 120 is trained around deflection rollers 120', 120''. A motor 121 drives deflection roller 120'.

A special yarn end preparation device 122 for residual packages 6 is located on the belt 120. This yarn end preparation device 122 comprises a sensor which senses the presence of a yarn end which has been successfully engaged by the yarn end preparation device 122. If this searching procedure for the yarn end was successful, this sensor actuates a shunt 123 via a control lead 123', to move the shunt to the position shown in FIG. 8 for guiding the appropriate tube support member onto another belt 124. The belt 124 is trained around deflection rollers 124',124''. A motor 125 drives the deflection roller 124'. A tube support member 3 shunted onto the belt 124 is then supplied via this belt 124 to a belt 32, as a result of which it subsequently passes via a reversing belt 26 again onto one of the belts 19 and therewith into an unwinding position 82.

If the sensor in the yarn end preparation device 122 has not sensed the presence of an end of a yarn, the shunt 123 is opened, so that it frees the path along the belt 120. As a result thereof, the particular tube support member 3 is transported against a deflection edge 126, which guides it onto a backup stretch 127. The backup stretch 127 is formed by a belt which is driven by a motor 128. A stop 129 stops tube support members 3 at the end of backup stretch 127. The unprepared residual packages 6 in the backup stretch 127 can then be subjected to a manual yarn end loosening operation by an operator before they are returned into the circuit.

If the sensor 112 senses only a slight winding remnant, the shunt 111 is pivoted into the position shown in FIG. 8. This causes the particular tube support member 3 to be deflected onto the belt 114, which is driven by a motor 115. A tube cleaning device 113 is located on this belt 114 for cleaning those tubes with only a slight winding remnant. After leaving this tube cleaning device, the particular tube support member 3 is transported by the belt 114 against a deflection edge 118 of a belt 116. This belt 116, which is trained around deflection rollers 116',116'', is driven by a motor 117. The tube support members are returned to the belt 20 by this belt 116.

The belt 59 can be located inside a package winding machine section or station, e.g. in the area of the last winding head. However, it is also possible to locate this belt between these two sections.

It is also possible, for example, to place two winding sections together by taking out the deflection profiles 103, 104, and removing the belt 59 and the stopper 55 in order to form a common circuit. To this end, the stops 87,88 of the reversing belt 26, would also be removed. If necessary, the plunger 101 is retracted, depending on whether the yarn end package preparation device 31 is to be operated. It is also conceivable to actuate the plunger 101 in cooperation with a sensor analogous to the control of the shunt 97 so that the tube support members 3 are supplied in alternating fashion to the two yarn end preparation devices 31.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A transport system for transporting independently movable tube support members, each tube support member having an upright post and being operable to individually support a tube of the type on which yarn has been built to form a yarn package or an empty tube, the transport system transporting the tube support members between the winding stations of a textile winding machine at which yarn is unwound from tubes and a manual re-supply location at which full yarn packages are manually loaded onto empty tube support members, the transport system comprising:

means forming a plurality of individual exit paths, each extending past a respective one of the winding stations, and at least one discharge path for receiving tube support members transported away from the winding stations by the individual exit paths for further transport of the tube support members to the manual re-supply location;

delivery path means for delivering tube support members from the manual re-supply location to the winding stations; and manual re-supply assisting means for assisting an operator with a manual re-supply operation in which full yarn packages are loaded onto empty tube support members, the manual re-supply assisting means including means forming a loading support path for supporting tube support members at the manual re-supply location, loading guide means for guiding full yarn packages during downward travel thereof onto empty tube support members disposed on the loading support path, and means for moving the loading guide means and the tube support members on the loading support path relative to one another to effect alignment of tube support members with the loading guide means for a manual re-supply operation, the loading guide means including at least two positioning members cooperating together to guide a yarn package downwardly onto an empty tube support member post, and the at least one of the positioning members being movable between a cooperating position in which it cooperates with the other positioning member to position a yarn package for downward travel and a displaced position in which it is laterally displaced from its cooperating position to thereby permit movement of the yarn packages on the tube support members disposed on the loading support path between the positioning members without interference therewith.

2. A transport system according to claim 1 wherein the common discharge path extends generally transversely to the individual exit paths, the loading support path extends generally parallel to the discharge path, the downstream end of the discharge path is communicated with the upstream end of the loading support path and the downstream end of the loading support path is communicated with the delivery path means.

3. A transport system according to claim 2 and further comprising a tube removal device disposed downstream of said individual exit paths and upstream of said loading guide means and a yarn sensor for sensing the presence of less than a predetermined minimum amount of yarn on a tube supported on a tube support member which has been discharged from a winding station, the tube removal device being operatively connected to the yarn sensor and being operable to remove from the support members those tubes having less than the predetermined minimum amount of yarn.

4. A transport system according to claim 1 wherein the means forming a loading support path includes an endless belt.

5. A transport system according to claim 1 wherein the delivery path means includes a first portion for delivering tube support members from the loading support path to a first group of winding stations, a second portion for delivering tube support members from the loading support path to a second group of winding stations, and the first portion includes a component repositionable along the travel path of the tube support members along the loading support path for varying the position at which the first portion transports tube support members away from the loading support to thereby permit variation in the number of winding stations in the first group of winding stations.

6. A transport system according to claim 1 and further comprising an automatic yarn package transfer component for automatically transferring yarn packages from a yarn package supply device adjacent the textile winding machine to empty tube support members, an automatic tube removal component for automatically removing tubes from tube support members fed to the automatic yarn package transfer component, and means for selectively bypassing the manual re-supply means including means for diverting tube support members from the discharge means to the automatic tube removal component and the automatic yarn package transfer component, and means for transporting tube support members with yarn packages thereon from the automatic yarn package transfer component to the delivery path means for delivery thereby to the winding stations.

7. A transport system according to claim 1 wherein the delivery path means includes a yarn end preparation device for preparing the yarn ends of yarn packages being transported by the delivery path means to the winding stations.

8. A transport system according to claim 2 wherein the delivery path means includes a reversible portion and a plurality of individual entrance path portions each for transporting tube support members from the reversible portion to a respective one of the winding units, the reversible portion being operable to cyclically reverse the direction of travel of the tube support members along the upstream ends of the individual entrance path portions and having a stop member at each respective end of the travel path of the tube support members on the reversible path to limit the travel of the tube support members.

9. A transport system according to claim 1 wherein each tube support member includes a base cylindrical portion and the loading guide means includes a plurality of pairs of said positioning members, each pair of positioning members for positioning a yarn package on a tube support member on the loading support path and the at least one of the positioning members of each pair of positioning members being movable between a cooperating position in which it cooperates with the other positioning member to position a yarn package and a displaced position in which it is laterally outwardly displaced from its cooperating position to thereby permit movement of the yarn packages on the tube support members disposed on the loading support path between the positioning members without interference therewith, and the pairs of positioning members being positioned at spacings from one another corresponding to the diameter of the base cylindrical portion of a tube support member such that the pairs of positioning members can be aligned in groupwise manner with a group of underlying tube support members disposed in successive substantially abutting engagement with one another on the loading support path.

10. A transport system according to claim 9 wherein the loading guide means includes means for synchronously moving the at least one movable positioning members of the pairs of positioning members between their cooperating and displaced positions.

11. A transport system according to claim 1 and further comprising sensing means, located adjacent the loading support path, for distinguishing between an empty tube support member and a tube support member having a tube thereon and stopping means for stopping the passage therepast of tube support members in response to the sensing by the sensing means of an empty tube support member for positioning the empty support members in position for a manual re-supply operation.

12. A transport system according to claim 11 wherein the loading guide means, the sensing means, and the stopping means are located adjacent the downstream end of the loading support path.

13. A transport system according to claim 1 wherein the means for relatively moving the loading guide means and the tube support members includes a device for moving the loading guide means along the travel path of the loading support path.

14. A transport system according to claim 9 wherein the means for relatively moving the loading guide means and the tube support members includes a rail extending generally parallel to the loading support path and a drive device for driving the loading guide means along the rail and further comprising means for controlling the movement of the loading guide means along the rail to effect stopping of the loading guide means at predetermined intervals along the rail, the predetermined intervals being selected such that the pairs of positioning members are aligned with underlying tube support members each time the loading guide means is stopped along the rail.

15. A transport system according to claim 1 wherein the manual re-supply assisting means includes a container for storing a plurality of yarn packages adjacent the loading guide means.

16. A transport system according to claim 12 wherein the stopping means includes means permitting manual manipulation of the stopping means to a non-stopping position.

* * * * *